United States Patent [19]

Zerrer

[11] Patent Number: 4,932,366

[45] Date of Patent: Jun. 12, 1990

[54] PORTABLE HANDHELD MOTOR-DRIVEN TOOL

[75] Inventor: Gerhard Zerrer, Korb, Fed. Rep. of Germany

[73] Assignee: Andreas Stihl, Waiblingen, Fed. Rep. of Germany

[21] Appl. No.: 369,137

[22] Filed: Jun. 21, 1989

[30] Foreign Application Priority Data

Jun. 29, 1988 [DE] Fed. Rep. of Germany ..... 3821951

[51] Int. Cl.[5] ..... F01P 7/00

[52] U.S. Cl. ..... 123/41.58; 123/41.59; 123/41.7

[58] Field of Search ..... 123/41.04, 41.07, 41.56, 123/41.58, 41.59, 41.65, 41.67, 41.7

[56] References Cited

U.S. PATENT DOCUMENTS

| | | | |
|---|---|---|---|
| 3,166,052 | 1/1965 | Parsons | 123/41.59 |
| 3,245,390 | 4/1966 | Roorda et al. | 123/142.5 R |
| 4,716,860 | 1/1988 | Henriksson et al. | 123/41.58 |

FOREIGN PATENT DOCUMENTS

| | | | |
|---|---|---|---|
| 1181003 | 11/1964 | Fed. Rep. of Germany | 123/41.59 |
| 782078 | 8/1957 | United Kingdom . | |
| 2054035 | 2/1981 | United Kingdom . | |

*Primary Examiner*—Noah P. Kamen
*Attorney, Agent, or Firm*—Walter Ottesen

[57] ABSTRACT

The invention is directed to handheld portable tools. An air temperature dependent cooling throttle flap controls the amount of cooling air passing over an air cooled engine. The arrangement of the throttle flap in an annular extension expels air in a manner not to annoy the operator.

5 Claims, 2 Drawing Sheets

PORTABLE HANDHELD MOTOR-DRIVEN TOOL

FIELD OF THE INVENTION

The invention relates to a portable handheld motor-driven tool such as a brushcutter having an air-cooled internal combustion engine. The housing of the engine is connected with a work tool via a guide tube. An air-cooled engine is mounted in the housing and is operatively connected to the work tool for driving the latter. The engine housing has an air-guiding channel for the cooling air.

BACKGROUND OF THE INVENTION

A brushcutter of the kind described above is disclosed in British Patent No. 2,054,035. In this brushcutter, the cooling air for the engine is drawn in and expelled at that end of the engine housing at which the guide tube is located. The warm air expelled from the engine housing can constitute an annoyance for the operator of the brushcutter. In addition, the constrained configuration does not permit the mounting of accessory devices in this region.

Air-cooled internal combustion engines often cause problems when starting and in the initial operational phase when the ambient temperature is very low. Icing on the carburetor and on the filter can occur and increased wear occurs because of inadequate lubrication. Accordingly, it has already been suggested that the cooling air flow be controlled in dependence upon the temperature of the engine as disclosed in U.S. Pat. No. 3,245,390 and British Patent No. 782,078. The cooling air flow is guided in a closed loop by means of the usual blower until the engine has warmed sufficiently. A throttle flap is then opened via a thermal controller which releases the heated cooling air to the ambient. In addition, a second throttle flap can be opened at another location of the engine housing in order to draw in fresh air from the ambient.

These arrangements are not usable in an internal combustion engine of a handheld portable tool because they cannot be accommodated in the spatially small engine housings of necessarily constrained configuration. There is no possibility provided for such a thermal control in the tool mentioned above and disclosed in British Patent No. 2,054,035 wherein the cooling air is expelled and drawn in at the same end of the housing.

SUMMARY OF THE INVENTION

It is an object of the invention to provide a handheld portable tool wherein the cooling air flow for the engine can be controlled in dependence upon the ambient temperature while retaining a constrained configuration which is not complex. It is another object of the invention to provide such a handheld portable tool wherein the air expelled from the housing does not constitute an annoyance for the operator thereof.

The handheld portable tool of the invention is a tool such as a brushcutter or the like. The portable tool includes: a housing; a guide tube having a rearward end connected to the housing and having a forward end; a work tool mounted on the forward end; an air-cooled engine mounted in the housing and being operatively connected to the work tool for driving the latter; the housing and the engine conjointly defining an air-guiding channel for conducting air around the engine; the housing having a housing end facing away from the guide tube; an annular extension mounted on the housing end so as to define a segment of the air-guiding channel; the annular extension having an opening connecting the air-guiding channel to the ambient; a throttle flap disposed in the annular extension between the segment of said air-guiding channel and the opening; the throttle flap being pivotally mounted in the annular extension so as to be movable between a first position wherein the opening is virtually closed to the ambient and a second position wherein the flap and the annular extension conjointly define an air inlet opening for passing air into the channel from the ambient and an air outlet opening for passing cooling air from the channel to the ambient; and, thermal control means mounted in the annular extension so as to be disposed in the region of the above-mentioned segment of the air-guiding channel for pivotally adjusting the flap in dependence upon the temperature of the cooling air conducted through the air-guiding channel.

The arrangement of the annular extension on the end of the housing lying opposite the guide tube permits the air-guiding channel to have a course for which, on the one hand, a closed cooling air flow loop is realized by means of a thermally-controlled throttle flap and, on the other hand, a release of outgoing air in a direction rearward of the operator is possible so that the operator is not annoyed by the outgoing heated air. The components necessary for the control, namely, the throttle flap and the thermal controller, are accommodated in the annular extension so that the constructive configuration of the engine within the housing does not have to be adapted to the control components. The annular extension imparts only a minimal increase to the length of the engine housing and can, with its components, be mounted on existing tools as a retrofit.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
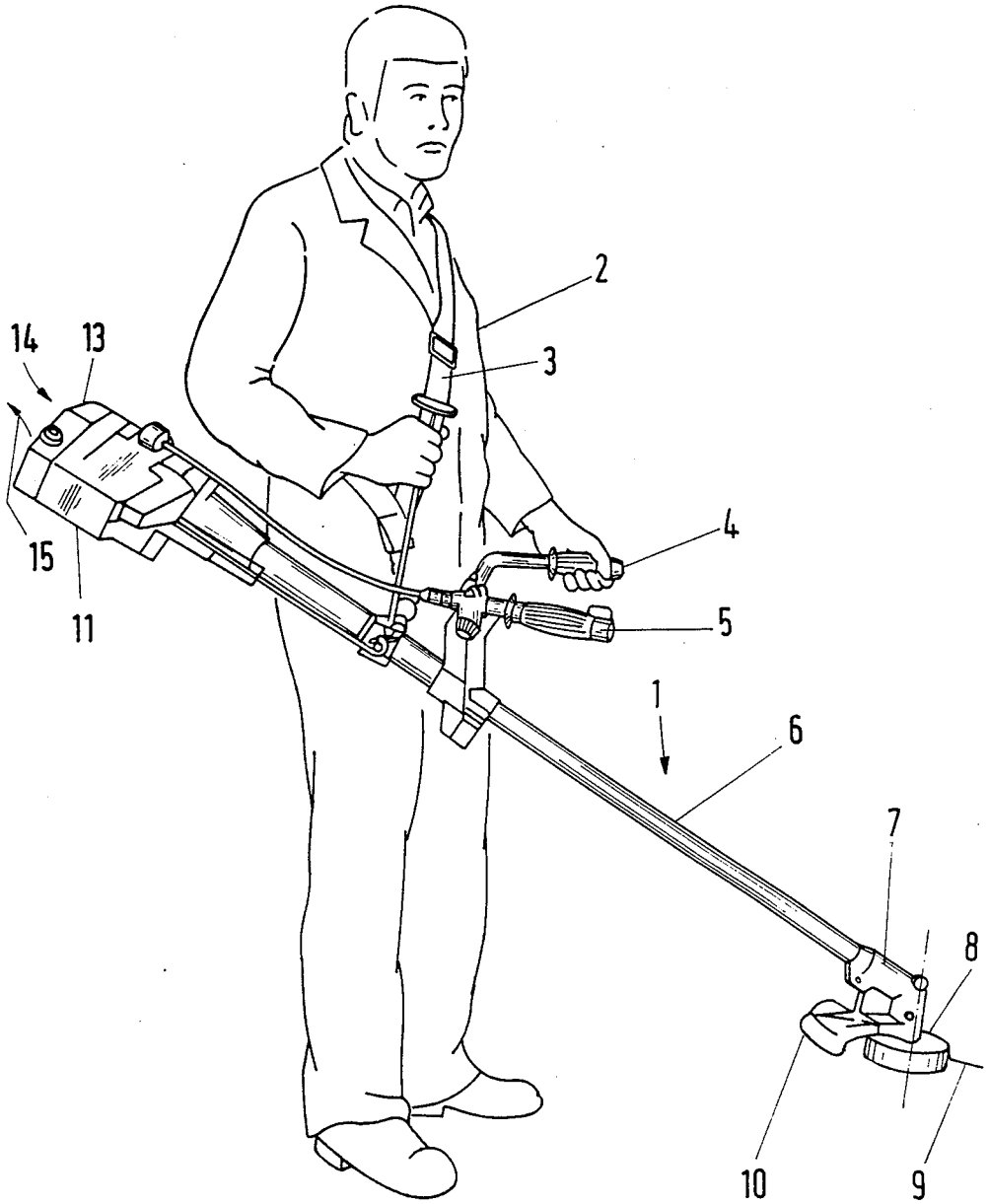
FIG. 1 is a perspective view of a brushcutter held in its operating position; and, FIG. 2 is a side elevation view, in axial section, of an internal combustion engine of a portable tool according to the invention.

The handheld portable tool shown in FIG. 1 is a brushcutter for cutting grass, plants, shrubs and the like. The brushcutter 1 is carried by the operator 2 by means of a shoulder belt 3 and is guided by hand at handles 4 and 5 which are attached at approximately the middle of the guide tube 6.

An angle-shaped connection piece 7 is attached to the lower end of the guide tube 6 wherein a cutterhead 8 is rotatably journalled. The cutterhead has a coil with a cutting filament wound thereon whose end segment 9 defines the cutting element. The cutterhead can be exchanged for other working tools in the usual manner. A protective hood 10 is provided on the connecting piece 7 for shielding against stones and the like which are thrown out during cutting operations.

An air-cooled internal combustion engine 11 is mounted at the upper end of the guide tube 6. The cutterhead 8 is driven by the engine 11 via a drive shaft arranged in the guide tube 6 and a gear transmission mounted in the connecting piece 7. The drive shaft is coupled to the crankshaft 12 (FIG. 2) of the engine 11.

The engine 11 has an air-guiding annular extension 13 at the rearward end of the engine housing facing away from the operator through which fresh cooling air can flow in for the engine 11 and through which outgoing air 15 can flow out to the ambient.

Figure 2:
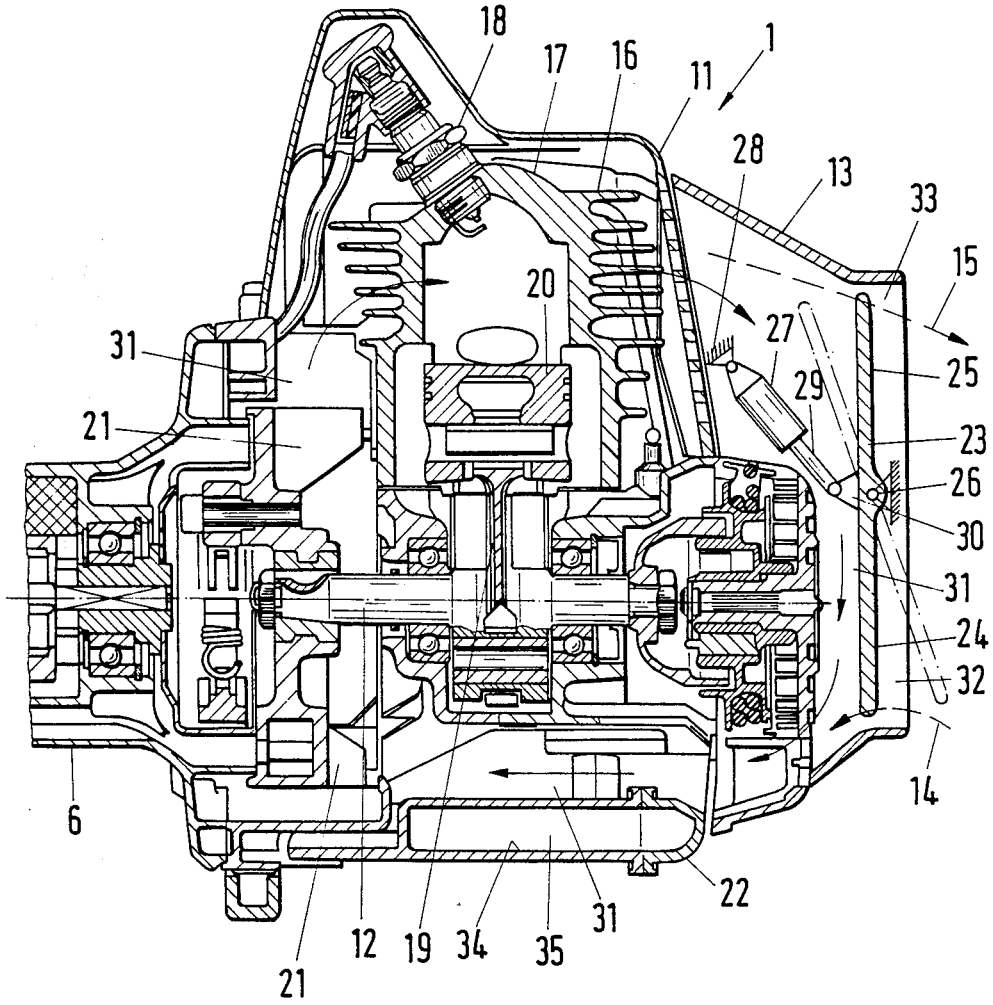

As shown in FIG. 2, the engine 11 includes a cylinder 17 having cooling ribs 16 and a spark plug 18. In addition, the engine includes a piston 20 which acts on the crankshaft 12 via the connecting rod 19 as well as a fan wheel 21 driven by the crankshaft 12. These parts are disposed inside of a housing 22.

The annular extension 13 is arranged at the rearward end of the engine lying opposite the fan wheel 21 and is attached to the engine housing 22 so as to be removable. The configuration of the air-guiding annular extension 13 as a separate component affords the advantage that the annular extension can be mounted on tools which already exist and which can thereby be retrofitted with this accessory device.

A throttling member configured as a flap 23 is mounted in the annular extension 13. The flap 23 is pivotally journalled at its center on a pivot shaft 26 attached to the annular extension 13 and therefore has two wings 24 and 25 of equal size. In the embodiment of FIG. 2, the pivot shaft 26 is preferably displaced somewhat above the crankshaft 12 and is aligned perpendicularly to the main axis of the crankshaft 12.

The flap 23 is pivoted in dependence upon temperature via a thermal controller 27 which, in the embodiment shown, is configured as an expansion controller and contains a mass of wax or the like which determines the operational condition of the controller by means of changes in volume. The controller 27 is configured as a piston-cylinder unit. The piston is pivotally connected at its one end to a journalling frame 28 fixedly attached to the housing and the piston rod 29 is pivotally connected to a lever 30 fixedly attached at the center of the flap 23. The volumetric change of the expansion material in the piston of the controller 27 occurring with changes of temperature causes an axial displacement of the piston rod 29 with the flap 23 being pivoted about its pivot shaft 26. The controller 27 is so arranged within the annular extension 13 that it lies in the region of the heated air coming from the engine cylinder 17.

The engine housing 22 and the annular extension 13 conjointly define a guide channel 31 which runs beneath the engine 11 and upwardly in the region of the cylinder 17 as well as between the rearward end of the engine and the flap 23 as shown in FIG. 2. At low ambient temperatures, the throttle flap 23 is shown in the position illustrated in FIG. 2 when the engine 11 is started so that the flow cross section of the annular extension 13 is virtually completely closed for the entry of fresh air 14 and the exit of outgoing air 15. In this way, a flow loop is formed for the air in the housing 22.

In correspondence to the arrows shown in FIG. 2, the air circulates through the lower portion of the guide channel 31 over the fan wheel 21 to the upper portion of the guide channel 31 and then to the rearward portion of the guide channel 31 and again back through the lower channel portion and thereby streams over and along all sides of the controller 27. Since the entry of fresh cold air via the flap 23 is virtually blocked, a rapid heating of the engine to the operating temperature is obtained and icing of the carburetor is avoided.

When the motor operating temperature has risen sufficiently, the controller 27 is warmed by the outgoing air to such an extent that the piston rod 29 moves out and the flap 23 opens more or less as indicated in phantom outline with the width of the opening of the flap being dependent upon the temperature of the outgoing air. In this way, an air inlet opening 32 is formed in the lower region of the annular extension 13 for the cold air 14 and an air outlet opening 33 is formed in the upper region for the outgoing air 15 so that the operating temperature cannot increase excessively.

An essential advantage of the configuration of the embodiment of the invention shown in FIG. 2 is that the entry of fresh air and the exit of outgoing air is provided at the same end of the tool 1 and therefore lies at a spacing behind the operator 2. Most importantly, the operator is in this way not annoyed by the heated outgoing air.

The throttle flap 23 in the annular extension 13 forms a cold weather operating device by means of which a corresponding temperature level can be maintained and an automatic temperature control of the cold air is achieved which, depending upon the position of the flap 23, can be mixed with more or less fresh air. The entry of foreign particles such as dirt and snow which are entrained by the fresh air is substantially reduced.

By means of the control arrangement according to the invention, the surfaces of the apparatus to be cooled are always flushed with the same quantity of cooling air which has its own temperature adapted to each ambient temperature so that the operating temperature of the engine can always be maintained at an optimal value substantially independently of the ambient temperature. A limitation or reduction of the cooling air flow does not occur with the control arrangement according to the invention so that all parts to which the air flows are cooled to the same extent and local overheating is not a concern which could lead to different expansions of material.

The fuel tank 35 is advantageously arranged so that it lies with at least one wall portion in the region of the cool air flow. In the embodiment of the invention shown, the fuel tank is disposed on the side of the apparatus lying opposite to the cylinder 17 such that at least its upper wall 34 facing toward the cylinder lies in the air flow. For this reason, a desired fuel preheating is obtained for very cold ambient temperatures which can likewise lead to a favorable operation of the engine. The control arrangement according to the invention provides for a mixing of the inflowing cooling air with the already heated outgoing air so that an operating temperature of the engine is obtained which is independent of the load on the engine and the temperature of the ambient air.

It is understood that the foregoing description is that of the preferred embodiments of the invention and that various changes and modifications may be made thereto without departing from the spirit and scope of the invention as defined in the appended claims.

What is claimed is:

1. A handheld portable tool such as a brushcutter or the like, the portable tool comprising:

a housing;

a guide tube having a rearward end connected to said housing and having a forward end;

a work tool mounted on said forward end;

an air-cooled engine mounted in said housing and being operatively connected to said work tool for driving the latter;

said housing and said engine conjointly defining an air-guiding channel for passing and circulating air around the engine;

said housing having a housing end facing away from said guide tube;

an annular extension mounted on said housing end so as to define a segment of said air-guiding channel;

said annular extension having an opening connecting said air-guiding channel to the ambient;

a throttle flap being pivotally mounted within said annular extension so as to be movable between a first position wherein said opening is virtually closed to the ambient and a second position wherein said flap and said annular extension conjointly define an air inlet opening for passing air into said channel from the ambient and an air outlet opening for passing said air from said channel back to the ambient; and, thermal control means mounted in said annular extension so as to be disposed in the region of said segment of said air-guiding channel for pivotally adjusting said flap in dependence upon the temperature of the cooling air conducted through said air-guiding channel.

2. The portable tool of claim 1, said engine having a crankshaft; said throttle flap having a pivot shaft arranged at its center for pivotally journalling said flap in said annular extension; and, said pivot shaft being displaced with respect to said crankshaft.

3. The portable tool of claim 1, said thermal control means being mounted in said annular extension so that the cooling air conducted away from the cylinder flows thereover.

4. The portable tool of claim 1, said throttle flap having a lever; said thermal control means including a rod displaceable in dependence upon temperature; and, said rod being pivotally connected to said lever for actuating said flap between said first and second positions.

5. The portable tool of claim 1, said engine including a fuel tank mounted in said housing so as to be disposed along said air-guiding channel so as to permit fuel in said tank to be prewarmed by the air flowing in said channel.

* * * * *